US008696777B1

(12) United States Patent
Patil et al.

(10) Patent No.: US 8,696,777 B1
(45) Date of Patent: Apr. 15, 2014

(54) MARINE ENGINE EXHAUST SYSTEMS HAVING AN OXYGEN SENSOR

(75) Inventors: Sunil K. R. Patil, Troy, MI (US); Scott C. Morton, Fond du Lac, WI (US); Andrew J. Przybyl, Berlin, WI (US); John A. Voit, Oakfield, WI (US); Ronald L. Hall, Hartford, WI (US); Daniel B. Slanker, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 13/316,164

(22) Filed: Dec. 9, 2011

(51) Int. Cl.
*F01N 3/00* (2006.01)
*G01D 11/24* (2006.01)
*G01M 15/10* (2006.01)

(52) U.S. Cl.
USPC ..... 55/385.3; 96/413; 96/417; 60/276; 60/323; 60/324; 73/23.32; 73/431

(58) Field of Classification Search
USPC ..... 55/385.3, DIG. 34; 96/413, 417; 60/276, 60/323, 324; 73/23.32, 431
See application file for complete search history.

(56) References Cited

U.S. PATENT DOCUMENTS

| | | | | |
|---|---|---|---|---|
| 7,552,586 | B1 | 6/2009 | White | |
| 7,698,889 | B1 | 4/2010 | Burk et al. | |
| 2006/0065041 | A1* | 3/2006 | Kono et al. | 73/23.32 |
| 2007/0277605 | A1* | 12/2007 | Fouts et al. | 73/431 |
| 2009/0199551 | A1* | 8/2009 | Kato et al. | 60/323 |
| 2010/0000201 | A1* | 1/2010 | Hoshi | 60/276 |
| 2010/0064663 | A1* | 3/2010 | Goya | 60/276 |
| 2011/0039461 | A1 | 2/2011 | White | |
| 2011/0047998 | A1* | 3/2011 | Adachi | 60/324 |
| 2011/0131953 | A1* | 6/2011 | Novak et al. | 60/276 |
| 2012/0096839 | A1* | 4/2012 | Chang | 60/276 |
| 2012/0186455 | A1* | 7/2012 | Ando et al. | 96/417 |

* cited by examiner

*Primary Examiner* — Robert Clemente
*Assistant Examiner* — Minh-Chau Pham
(74) *Attorney, Agent, or Firm* — Andrus, Sceales, Starke & Sawall, LLP

(57) ABSTRACT

A marine engine exhaust system has an exhaust conduit conveying engine exhaust gas from upstream to downstream, a sensor sensing oxygen content of the exhaust gas in the conduit, and a shield located in the conduit. The shield is configured to shield the sensor from deleterious effects of liquid when liquid and exhaust gas is reverted in the exhaust conduit from downstream to upstream.

16 Claims, 7 Drawing Sheets

MARINE ENGINE EXHAUST SYSTEMS HAVING AN OXYGEN SENSOR

FIELD

The present disclosure relates to marine vessels and more particularly to exhaust systems for internal combustion engines on marine vessels.

BACKGROUND

U.S. Pat. No. 7,552,586, the disclosure of which is incorporated herein by reference, discloses a marine exhaust system having an oxygen sensor located within a catalyst housing structure and downstream of a catalyst device. The oxygen sensor is located away from a reversion liquid trajectory path that defines the likely path of liquid flowing in a reverse direction through the marine engine exhaust system toward a plurality of exhaust ports of the engine. By locating the engine sensor away from this reversion liquid trajectory path, the likelihood of damage to the oxygen sensor from contact with liquid is significantly reduced.

U.S. Pat. No. 7,698,889, the disclosure of which is incorporated herein by reference, discloses a porous member disposed within the exhaust stream of a marine engine at a location where its temperature approximates the temperature of the exhaust stream through normal use of the engine. Exhaust gas flows freely through the non-catalytic porous member, but liquid passing in a reverse direction through the exhaust system is vaporized as it attempts to flow through the non-catalytic porous member.

U.S. Patent Application Publication No. 2011/0039461, the disclosure of which is incorporated herein by reference, discloses a plenum provided upstream from a catalyst module and downstream from a plurality of exhaust ports of a marine engine. The plenum is provided with a cross-sectional area that induces exhaust gas to slow as it passes from the plurality of exhaust ports into the plenum. This slowing of the velocity of exhaust gas improves the probability that the exhaust gas will be more evenly distributed across the inlet surface of the catalyst module.

SUMMARY

This summary is provided to introduce a selection of concepts that are further described herein below in the detailed description. This summary is not intended to identify key or essential features of the claimed subject matter, nor is it intended to be used as an aid in limiting the scope of the claimed subject matter.

The present disclosure provides examples of marine engine exhaust systems that include an exhaust conduit conveying engine exhaust gas from upstream to downstream, a sensor sensing oxygen content of the exhaust gas in the conduit, and a shield located in the conduit. In some examples, the shield is configured to shield the sensor from deleterious effects of liquid when liquid and exhaust gas is reverted in the exhaust conduit from downstream to upstream. During forward flow of exhaust gas from upstream to downstream, a wake region of flow-induced low pressure is formed downstream of the sensor, and the shield can be at least partially disposed in this wake region. In some examples, the shield includes a boss. In other examples, the shield includes a wall. In yet other examples, the shield includes a jacket on the sensor.

In other examples, methods of making a marine engine exhaust system comprise: providing an exhaust conduit for conveying engine exhaust gas from upstream to downstream, inserting a sensor for sensing oxygen content of the exhaust gas in the conduit, identifying a wake region of flow-induced low pressure downstream of the sensor during flow of exhaust gas through the conduit from upstream to downstream, and disposing a shield at least partially in the wake region to shield the sensor from deleterious effects of liquid when liquid and exhaust gas is reverted in the exhaust conduit from downstream to upstream.

BRIEF DESCRIPTION OF THE DRAWINGS

Embodiments of marine engine exhaust systems are described with reference to the following drawing figures. The same numbers are used throughout the figures to reference like features and components.

DETAILED DESCRIPTION OF THE DRAWINGS

In the present disclosure, certain terms have been used for brevity, clearness and understanding. No unnecessary limitations are to be inferred therefrom beyond the requirement of the prior art because such terms are used for descriptive purposes only and are intended to be broadly construed. Various equivalents, alternatives and modifications are possible within the scope of the appended claims.

Examples of marine engine exhaust systems having an oxygen sensor are provided herein. The present disclosure is the product of the present inventors' research and development of marine vessels and more particularly to exhaust systems for internal combustion engines on marine vessels. Through research and experimentation, the inventors have recognized that reversion of liquid in an exhaust conduit carrying exhaust gas from upstream to downstream can have deleterious effects on a sensor sensing oxygen content of the exhaust gas in the conduit. The inventors have also realized that prior art solutions of locating the oxygen sensor away from the reversion liquid trajectory path are not always feasible in view of engine space constraints. The inventors have further realized that prior art methods of self-cleaning of the oxygen sensor through shear stress at the surface of the sensor caused by higher-speed engine operation can be inadequate. Specifically, the inventors have realized that such methods do not always effectively remove liquid or solid deposits from downstream areas of the sensor, i.e. those areas located in a presently identified low-speed wake region formed during forward flow of exhaust gas through the conduit.

Figure 1:
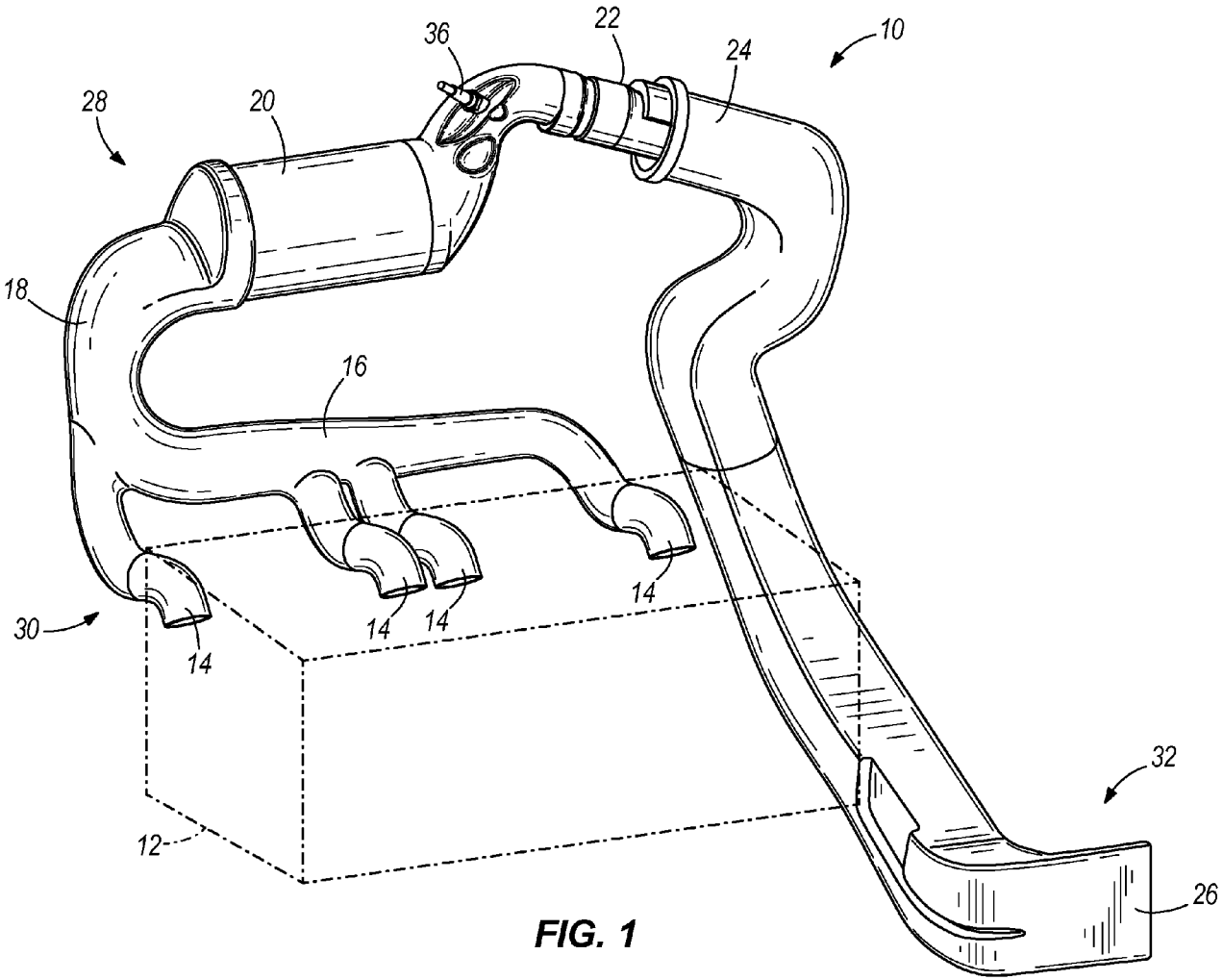
FIG. 1 is a perspective view of portions of a marine engine exhaust system.

FIG. 1 depicts portions of an exhaust system 10 for an internal combustion engine 12 on a marine vessel. In this example, the exhaust system 10 is configured for a sterndrive or inboard catalyst-equipped engine; however the present invention is not necessary limited for use with this type of marine propulsion arrangement. A plurality of exhaust ports 14 receives bulk exhaust gas from the internal combustion engine 12. The exhaust gas is conveyed through the exhaust ports 14 and mixed in an exhaust manifold 16. From the exhaust manifold 16, exhaust gas is conveyed through a header 18 to a catalyst housing 20, in which a catalyst is disposed for treating the exhaust gas. Exhaust gas flows through the catalyst in the catalyst housing 20 and into an exhaust elbow 22 wherein the exhaust is cooled by cooling liquid flowing peripherally through a cooling jacket (not shown) along the outer surfaces of the elbow 22. According to conventional arrangements, cooling liquid such as sea water flows through the cooling jacket and is discharged into the flow of exhaust gas at or downstream of elbow 22 for mixing with exhaust gas and for further cooling thereof. Discharge of cooling liquid occurs at a turbulent mixing zone 24, which in the depicted example is at the elbow 22. Again, the location of the mixing zone 24 can vary. Thereafter, a mixture of cooling liquid and exhaust gas is conveyed from the mixing zone 24 for discharge via an exhaust outlet 26, which can be located at for example a propeller housing for the marine vessel or through the transom of the vessel. The location of the discharge can vary and is not critical. The exhaust system 10 thus provides an exhaust conduit 28 conveying engine exhaust gas from upstream 30 at the internal combustion engine 12 to downstream 32 at the exhaust outlet 26.

Figure 2:
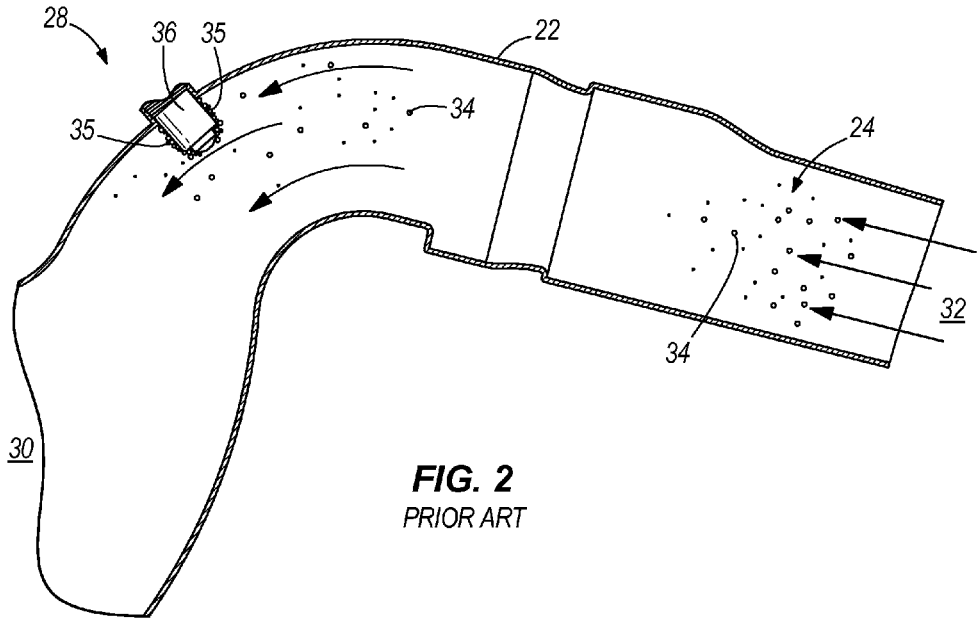
FIG. 2 PRIOR ART
FIG. 2 is a sectional view of an exhaust elbow and oxygen sensor in the elbow, depicting reverse flow of exhaust gas and fluid droplets.

Referring to FIG. 2, a conventional post-catalyst oxygen sensor 36 is disposed in the elbow 22 of the exhaust conduit 28. The oxygen sensor 36 is configured to sense oxygen content of the exhaust gas in the exhaust conduit 28, as the exhaust gas flows from upstream 30 to downstream 32. The oxygen sensor 36 can be configured for placement near the noted catalyst to monitor the amount of oxygen in the exhaust gas and to then convey this information to an engine control circuit for controlling operation of the internal combustion engine 12. This type of arrangement is known and the oxygen sensor 36 can be obtained for example from such providers as Bosch and NTK.

The present inventors realize that during idling conditions of the engine 12, there are brief periods during each engine cycle where the exhaust gas reverses direction and flows back towards the internal combustion engine 12 from downstream to upstream. This is due to intake/exhaust valve temporal overlap. This reverse exhaust pulse can carry liquid droplets from the turbulent mixing zone 24 back towards the oxygen sensor 36, and in some cases all the way back to the catalyst in the catalyst housing 20. This is often referred to in the art as liquid reversion phenomena. The size of the liquid droplets 34 that are carried from downstream to upstream can vary depending upon the pressure, temperature, and turbulence of the reverse exhaust pulse. As shown in FIG. 2, the liquid droplets 34 often strike the relatively hot oxygen sensor 36. The liquid droplets 34 are known to boil on the oxygen sensor 36 and deposit salt and minerals on the sensor 36. If this condition persists, deposits from the liquid droplets 34 can cover the oxygen sensor 36 and plug the holes and adversely affect its performance and thus the performance of the engine's control system.

Figure 3:
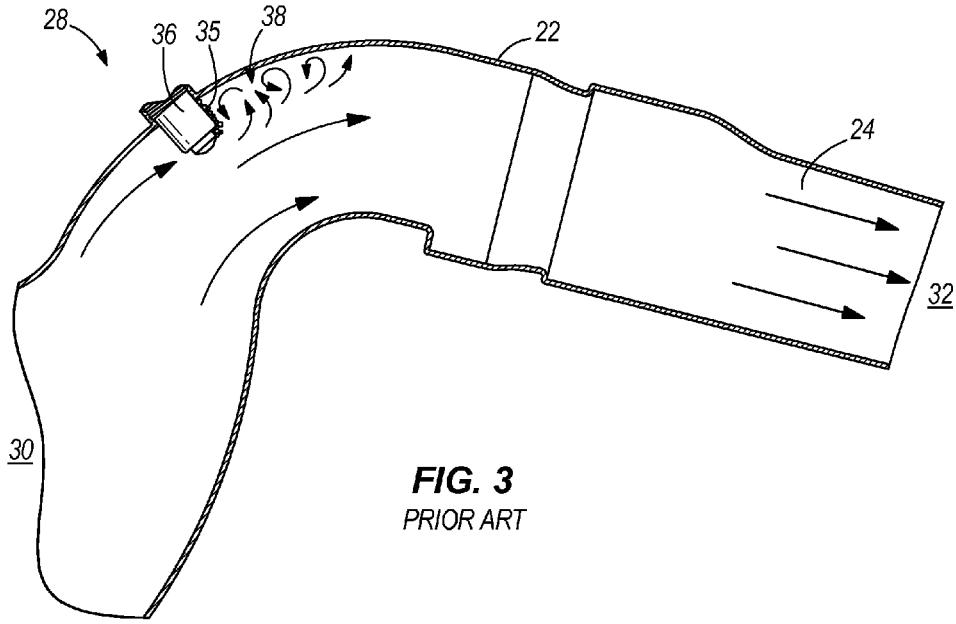
FIG. 3 PRIOR ART
FIG. 3 is a view like FIG. 2 depicting forward flow of exhaust gas.

FIG. 3 depicts the elbow 22 and oxygen sensor 36 during a relatively high speed operation of the internal combustion engine 12. Once the oxygen sensor 36 has become covered in deposits during the aforementioned idling operation, high speed operation of the internal combustion engine 12 produces high-speed forward exhaust gas flow that is expected to remove the deposits from the sensor 36 by flow-induced shear stress on the surfaces of the sensor 36. However, the present inventors have determined that this process is not always sufficient to clean the deposits from the sensor 36. Quite often, salt or mineral deposits 35 remain on the sensor 36 in spite of the noted flow-induced shear stress. In particular, deposits 35 located on the downstream face of the oxygen sensor 36 reside adjacent or near a wake region 38 of flow-induced low pressure, wherein during normal forward flow of exhaust gas, the gas velocities remain low, regardless of the engine speed. This flow-induced low pressure prevents the aforementioned "self-cleaning" of the oxygen sensor 36 in the areas of the oxygen sensor 36 at or near the wake region 38. Through experimentation, the inventors have determined that areas of the oxygen sensor 36 at or near the noted wake region 38 are not subjected to sufficient exhaust flow-induced shear stress, and thus deposits are not cleaned from these areas at above idle speeds of the internal combustion engine 12. As noted above, prior art solutions of locating the oxygen sensor away from the reversion liquid trajectory path are not always feasible in view of engine space constraints. Therefore, the inventors have found it desirable to have the freedom to place the oxygen sensor 36 at any location with respect to the catalyst while still reducing the deleterious effects of liquid when liquid and exhaust gas are reverted in the exhaust conduit 28 from downstream 32 to upstream 30.

Figure 4:
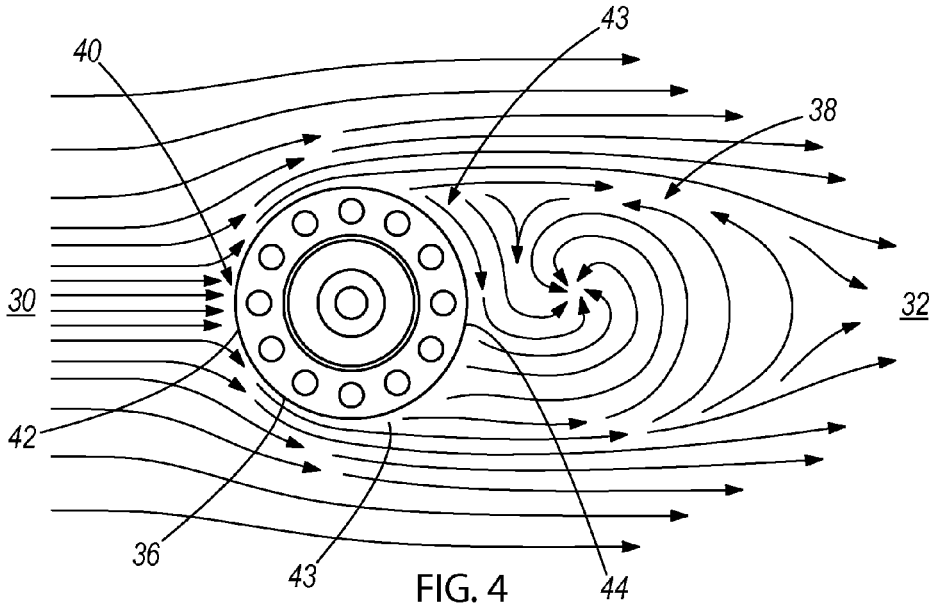
FIG. 4 PRIOR ART
FIG. 4 is a top view of the oxygen sensor depicting forward flow of exhaust gas across the oxygen sensor.
Figure 5:
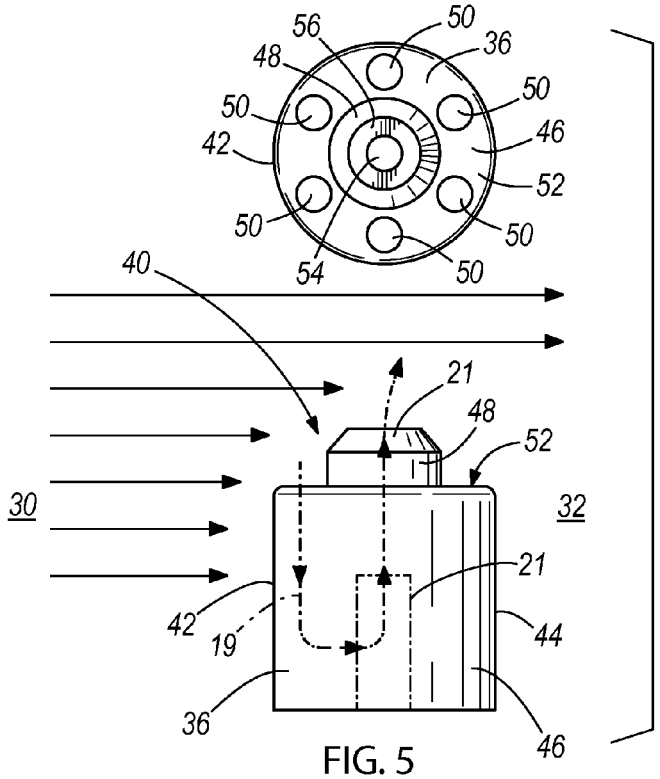
FIG. 5 PRIOR ART
FIG. 5 is a top view and a side view of the oxygen sensor, depicting forward flow of exhaust gas across the oxygen sensor.

FIGS. 4 and 5 depict forward flow of exhaust gas across the oxygen sensor 36 during operation of the internal combustion engine 12. As shown in FIG. 4, the present inventors have realized that a stagnation region 40 of flow-induced high pressure forms on the upstream face 42 of the oxygen sensor 36. The noted wake region 38 of flow-induced low pressure exhibits a recirculating, low-speed flow proximate the downstream face 44 of the oxygen sensor 36. Separation regions 43 exist between the stagnation region 40 and wake region 38, where velocity of the exhaust flow decreases dramatically.

Referring to FIG. 5, the oxygen sensor 36 is cylindrically-shaped and has body 46 and a head 48 extending above the body 46. A plurality of inlet holes 50 are circumferentially spaced around the top 52 of the body 46. An outlet hole 54 is disposed in the top 56 of the head 48. As exhaust flows from upstream 30 to downstream 32 across the oxygen sensor 36, stagnation pressure builds at the stagnation region 40, thus forcing, the exhaust gas downwardly into the inlet holes 50 as shown at arrow 19. The exhaust gas flows through the oxygen sensor 36 and across a reactive element 21 inside of the body 46 for sensing the oxygen content of the exhaust gas according to conventional means. Relatively high-speed flow of exhaust gas across the outlet hole 54 creates a low pressure (i.e. a Bernoulli effect), which draws exhaust gas out of the body 46 as shown at arrow 21.

Figure 6:
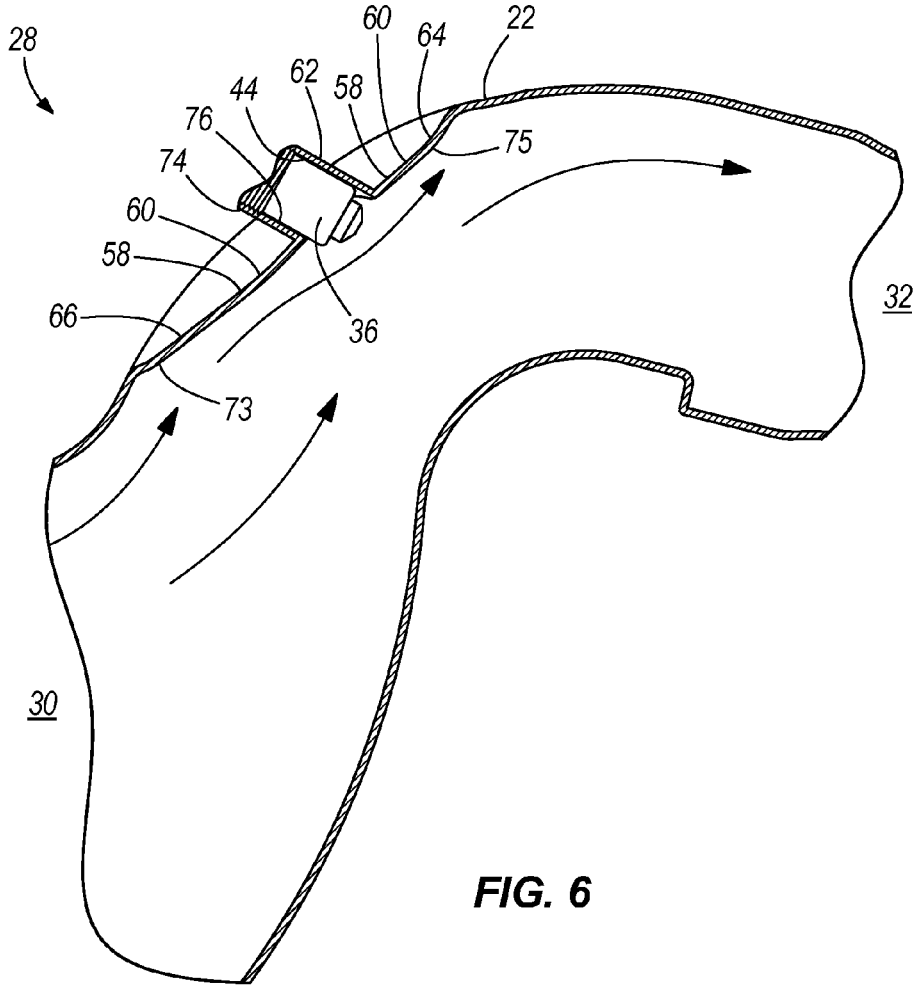
FIG. 6 is a sectional view of the elbow and a shield for the oxygen sensor.
Figure 7:
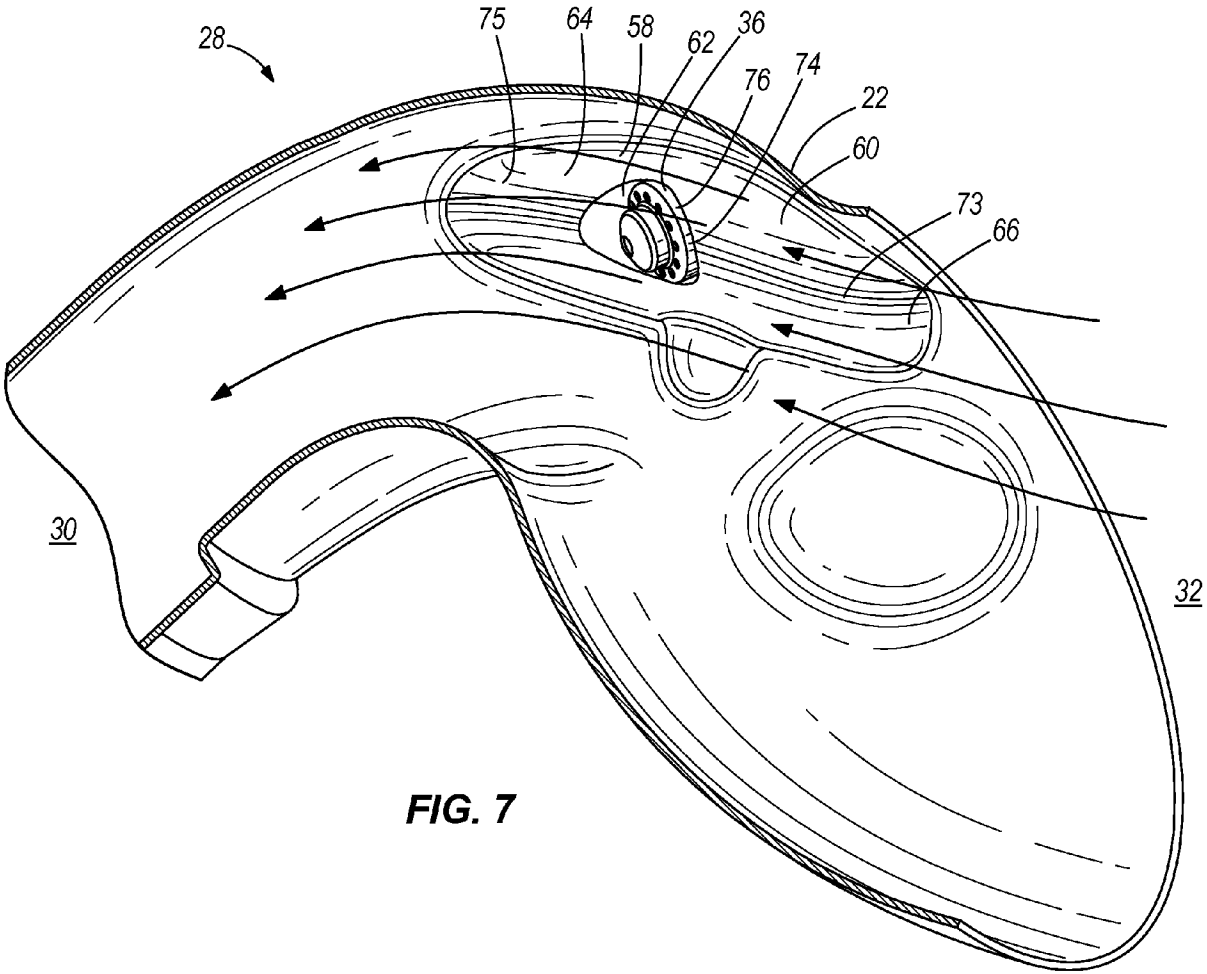
FIG. 7 is a sectional view of the elbow depicting forward flow of exhaust gas across the shield and oxygen sensor.

FIG. 6 depicts the exhaust elbow 22 and oxygen sensor 36 sensing oxygen content of exhaust gas in the exhaust conduit 28. A shield 58 is located in the conduit 28 for shielding the oxygen sensor 36 from reversion flow of liquid and exhaust gas, thereby preventing deleterious effects of liquid on the oxygen sensor 36 when liquid and exhaust gas is reverted in the exhaust conduit 28 from downstream 32 to upstream 30. In this example, the shield 58 is disposed in and entirely fills the wake region 38; however the shield 58 can instead only partially reside in and fill the wake region 38. The shield 58 can have different shapes and sizes. In this particular example, the shield 58 comprises a boss 60 that is located both upstream and downstream of the oxygen sensor 36. The shield 58 has outer surfaces 73, 75 that are smooth and taper away from the oxygen sensor towards the inner diameter of the conduit 28 so that the surfaces are self-cleaning by flow-induced shear stress during forward flow of exhaust gas from upstream 30 to downstream 32. As shown in FIGS. 6 and 7, the boss is cast into the exhaust conduit 28 and has an upstream face 62 that conforms to the downstream face 44 of the oxygen sensor 36. The oxygen sensor 36 in this example is generally cylindrical in shape and therefore the upstream face 62 of the boss 60 is concave so as to conform to the cylindrical downstream face 44 of the oxygen sensor 36. As shown, the boss 60 has a first portion 64 located downstream of the oxygen sensor 36 and a second portion 66 located upstream of the oxygen sensor 36. The first portion 64 has a height that is greater than the oxygen sensor 36. The second portion 66 of the boss 60 has a height that is less than the oxygen sensor 36 so that the boss 60 does not interfere with flow across the outlet hole 54 of the oxygen sensor 36, as described above with reference to FIG. 5. In this example, the second portion 66 of the boss 60 is shaped so as to not decrease the pressure at the stagnation region 40 proximate the oxygen sensor 36. Specifically, the second portion 66 is taller than the outer body 46 and shorter than the inner head 48 of the oxygen sensor 36. The second portion 66 has a downstream face 74 that conforms to the upstream face 76 of the oxygen sensor 36. In this example, the shield 58 is advantageously formed in such a way that flow through the oxygen sensor 36 is not altered so that closed loop air-fuel control still functions properly. The shield 58 shields the oxygen sensor 36 from the liquid droplets 34 so that all or substantially all deposits 35 are on the boss 60. The boss 60 is self-cleaning during forward exhaust flow such that the deposits 35 on the boss 60 are in direct contact with medium or high velocity forward exhaust pulses. In prior art arrangements, the noted wake region 38 prevented this self-cleaning feature. The example shown in FIGS. 6 and 7 is not limiting and the boss 60 can have other heights with respect to the oxygen sensor 36.

Figure 8:
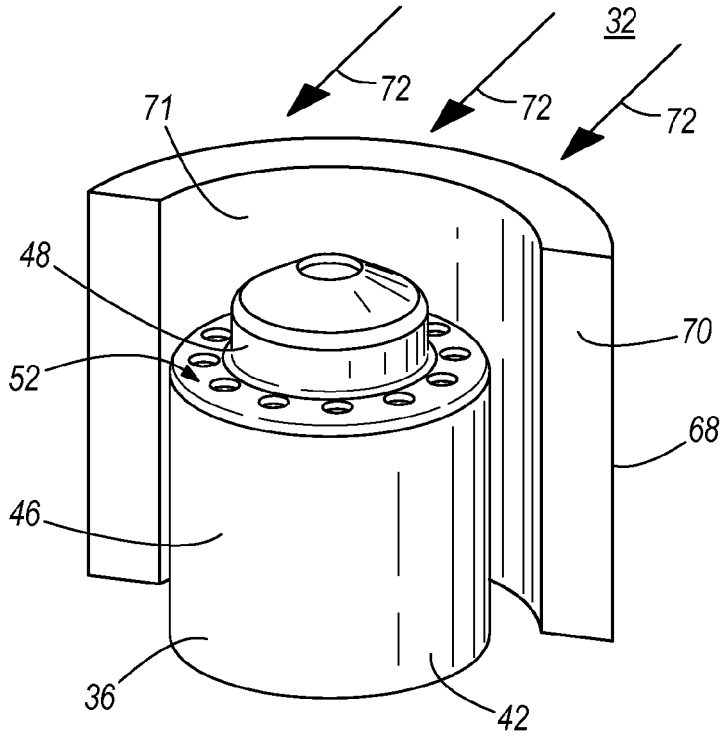
FIG. 8 is a perspective view of the oxygen sensor and another example of a shield for the oxygen sensor.
Figure 9:
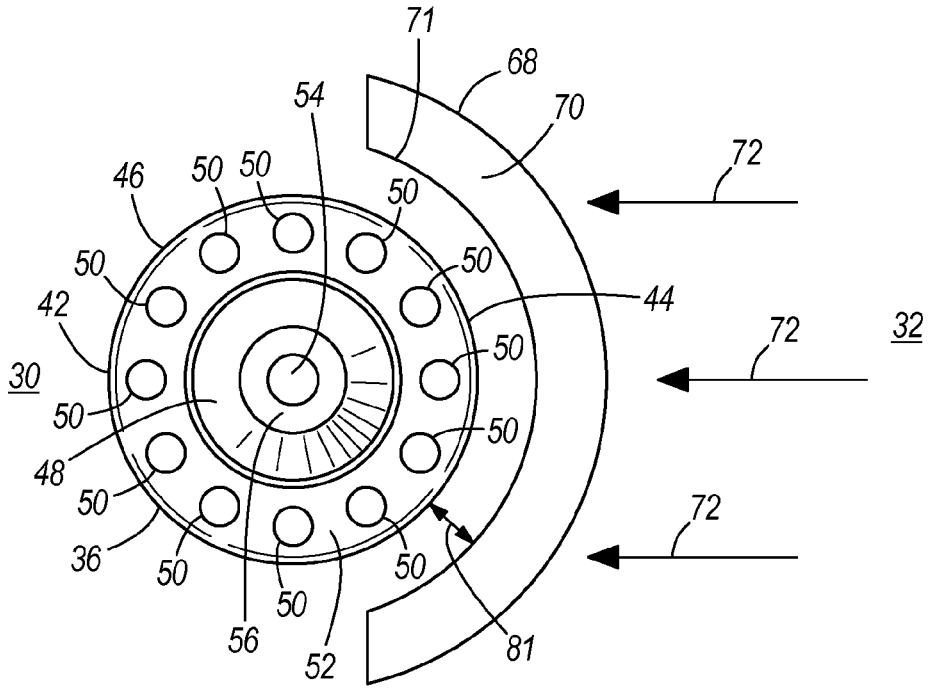
FIG. 9 is a top view of the example shown in FIG. 8 depicting reverse flow of exhaust gas across the shield.

FIGS. 8 and 9 depict another example of a shield 68 located in the exhaust conduit 28 and shielding the oxygen sensor 36 from reversion flow of liquid and exhaust gas so as to prevent deleterious effects of liquid on the sensor 36 when liquid and exhaust gas is reverted in the exhaust conduit 28 from downstream 32 to upstream 30. In this example, the shield 68 comprises a wall 70 that has an umbrella-shape and that has a height that is greater than the sensor 36. The wall 70 has an inner face 71 that conforms to the downstream face 44 of the oxygen sensor 36 so that it effectively blocks flow of exhaust gas and liquid from downstream 32 to upstream 30 as shown at arrows 72. A gap 81 exists between the outer face 42 of the oxygen sensor 36 and the shield 68.

Figure 11:
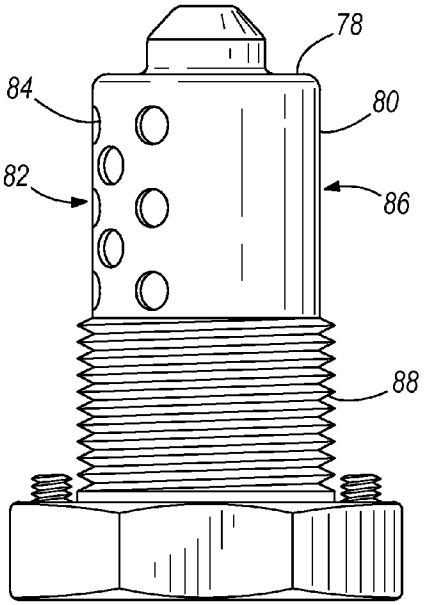
FIG. 11 is an isolated perspective view depicting the shield of FIG. 10.
Figure 10:
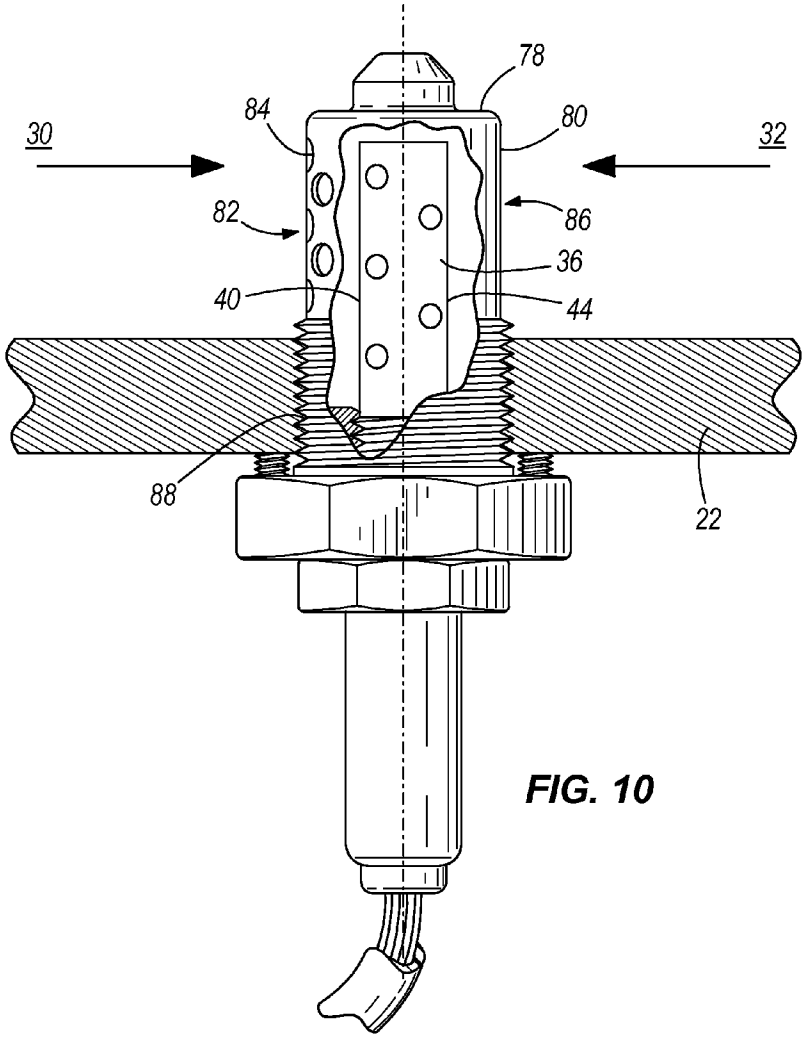
FIG. 10 is a view, partially cut-away, of another example of the shield for the oxygen sensor.

FIGS. 10 and 11 depict another example of a shield 78 that includes a removable jacket 80 disposed on the oxygen sensor 36. The jacket 80 is removably connected to the exhaust conduit 28 at the elbow 22 and has an upstream face 82 having holes 84 for receiving flow of exhaust gas and a downstream face 86 that is impermeable. The jacket 80 is connected to the exhaust conduit 28 at a threaded connection 88; however other connection methods can be employed for releasably affixing the shield 78 to the conduit 28. The outer surface of the jacket 80 can be indexed so that more or less holes 84 are positioned upstream of the oxygen sensor 36, thus providing increased or decreased shielding of the oxygen sensor 36. Removal of the jacket 80 allows for cleaning thereof.

According to the concepts of the present disclosure, it is thus possible to make make a marine engine exhaust system by first identifying a wake region of flow-induced low pressure downstream of the sensor during flow of exhaust gas through the conduit from upstream to downstream, and then disposing a shield at least partially in the wake region to shield the sensor from deleterious effects of liquid when liquid and exhaust gas is reverted in the exhaust conduit from downstream to upstream.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means plus function clauses are intended to cover the structures described herein as performing the recited function and not only structural equivalents, but also equivalent structures. Thus, although a nail and a screw may not be structural equivalents in that a nail employs a cylindrical surface to secure wooden parts together, and whereas a screw employs a helical surface, in the environment of fastening wooden parts, a nail and a screw may be equivalent structures. It is the express intention of the applicant not to invoke 35 U.S.C. §112, paragraph six, for any limitations of any of the claims herein, except for those in which the claim expressly uses the words "means for" together with an associated function.

What is claimed is:

1. A marine engine exhaust system comprising an exhaust conduit conveying engine exhaust gas from upstream to downstream, a sensor sensing oxygen content of the exhaust gas in the conduit, and a shield located in the conduit and shielding the sensor from deleterious effects of liquid when liquid and exhaust gas is reverted in the exhaust conduit from downstream to upstream;

wherein during flow of exhaust gas from upstream to downstream, a wake region of flow-induced low pressure is formed downstream of the sensor, and wherein the shield is at least partially disposed in the wake region; and wherein the shield comprises a boss that extends inwardly from the exhaust conduit and is located at least downstream of the sensor.

2. A system according to claim 1, wherein the shield entirely fills the wake region.

3. A system according to claim 1, wherein all surfaces of the shield and sensor are self-cleaning by flow-induced shear stress during flow of exhaust gas from upstream to downstream.

4. A system according to claim 1, wherein the boss is cast into the exhaust conduit.

5. A system according to claim 1, wherein the boss has an upstream face that conforms to a downstream face of the sensor.

6. A system according to claim 5, wherein the sensor is cylindrical and wherein the upstream face of the boss is concave so as to conform to the downstream face of the sensor.

7. A system according to claim 1, wherein the boss has a height that is greater than the sensor.

8. A system according to claim 1, wherein the boss comprises a first portion located downstream of the sensor and a second portion located upstream of the sensor.

9. A system according to claim 8, wherein the first portion of the boss has a height that is less than the sensor and wherein the second portion of the boss has a height that is less than the sensor.

10. A system according to claim 9, wherein the first portion of the boss is shaped so as to not decrease flow of exhaust gas out of the sensor and wherein the second portion of the boss is shaped so as to not decrease stagnation pressure regions at the sensor.

11. A system according to claim 1, wherein the shield has an outer surface that is smooth and tapers away from the sensor towards an inner diameter of the exhaust conduit.

12. A marine engine exhaust system comprising an exhaust conduit conveying engine exhaust gas from upstream to downstream, a sensor comprising a body and a reactive element in the body for sensing oxygen content of the exhaust gas in the conduit, and a shield located in the conduit and shielding the sensor from deleterious effects of liquid when liquid and exhaust gas is reverted in the exhaust conduit from downstream to upstream;

wherein during flow of exhaust gas from upstream to downstream, a wake region of flow-induced low pressure is formed downstream of the sensor, and wherein the shield is at least partially disposed in the wake region;

wherein the shield comprises a wall that extends inwardly of the exhaust conduit and is located downstream of the body;

wherein the wall is umbrella-shaped; and wherein the wall has a height that is greater than the sensor.

13. A marine engine exhaust system comprising an exhaust conduit conveying engine exhaust gas from upstream to downstream, a sensor sensing oxygen content of the exhaust gas in the conduit, and a shield located in the conduit and shielding the sensor from deleterious effects of liquid when liquid and exhaust gas is reverted in the exhaust conduit from downstream to upstream;

wherein the shield comprises a removable jacket disposed on a body that covers the reactive element of the sensor;

wherein the jacket comprises an upstream face having holes for receiving exhaust gas and a downstream face that is impermeable; and wherein the jacket can be indexed so that more or less holes of the jacket are positioned downstream of the sensor.

14. A system according to claim 13, wherein the jacket is releasably connected to the exhaust conduit.

15. A marine engine exhaust system comprising an exhaust conduit conveying engine exhaust gas from upstream to downstream; a sensor sensing oxygen content of the exhaust gas in the conduit, wherein the sensor comprises a reactive element, a body on the reactive element and a head extending above the body; wherein at least one hole is formed in at least one of the body and head, allowing flow of exhaust gas to the reactive element, and a boss preventing deleterious effects of liquid on the sensor when liquid and exhaust gas is reverted in the exhaust conduit from downstream to upstream, the boss comprising a portion located downstream of the sensor and being taller than the body and shorter than the head: the boss further comprising a portion located upstream of the sensor and being shorter than the body.

16. A method of making a marine engine exhaust system comprising: providing an exhaust conduit for conveying engine exhaust gas from upstream to downstream, inserting a sensor comprising a body and a reactive element in the body for sensing oxygen content of the exhaust gas in the conduit, identifying a wake region of flow-induced low pressure downstream of the sensor during flow of exhaust gas through the conduit from upstream to downstream, and disposing a shield at least partially in the wake region to shield the sensor from deleterious effects of liquid when liquid and exhaust gas is reverted in the exhaust conduit from downstream to upstream, the shield filling the wake region.

* * * * *